United States Patent [19]

Muchisky

[11] 4,102,334

[45] Jul. 25, 1978

[54] MASSAGE UNIT

[76] Inventor: Thomas Peter Muchisky, 12153 Queen's Charter Ct., Creve Coeur, Mo. 63141

[21] Appl. No.: 750,507

[22] Filed: Dec. 14, 1976

[51] Int. Cl.[2] ..... A61H 1/00

[52] U.S. Cl. ..... 128/36; 128/55

[58] Field of Search ..... 128/34–36, 128/44–46, 54, 55

[56] References Cited

U.S. PATENT DOCUMENTS

| | | | |
|---|---|---|---|
| 750,735 | 1/1904 | Turck | 128/36 |
| 920,814 | 5/1909 | Behm et al. | 128/35 |
| 976,423 | 11/1910 | Ziegler | 128/51 |
| 1,234,700 | 7/1917 | McLain | 128/41 |
| 1,301,866 | 4/1919 | Moore | 128/35 |
| 1,723,268 | 8/1929 | Conill | 128/36 |
| 1,958,936 | 5/1934 | Bajette et al. | 128/35 |
| 2,174,452 | 9/1939 | Torrison | 128/36 |
| 2,422,639 | 6/1947 | Wenander | 259/1 |
| 2,675,800 | 4/1954 | Voorhees et al. | 128/36 |
| 3,053,250 | 9/1962 | Stubbs | 128/41 |
| 3,314,417 | 4/1967 | Starre et al. | 128/36 |
| 3,314,418 | 4/1967 | Tiemes | 128/36 |
| 3,468,304 | 9/1969 | Teranishi | 128/36 |
| 3,504,665 | 4/1970 | Bakunin et al. | 128/36 |

FOREIGN PATENT DOCUMENTS

| | | | |
|---|---|---|---|
| 243,173 | 2/1912 | Fed. Rep. of Germany | 128/35 |
| 818,679 | 10/1951 | Fed. Rep. of Germany | 128/36 |

*Primary Examiner*—Lawrence W. Trapp

*Attorney, Agent, or Firm*—Rogers, Eilers and Howell

[57] ABSTRACT

A massage unit used for therapeutic purposes such as to loosen and mobilize bronchial secretions in humans; to improve blood circulation, and; to relax muscles, has a motor unit which transmits rotary motion to a cable engaged to an applicator unit. The applicator unit has a lower gripping portion which rotatably mounts an eccentric drive assembly which is drivingly coupled to the cable so as to be oscillated by cable rotation. An elbow-shaped tube extends upwardly and outwardly from the eccentric assembly so that an application pad mounted on the outer end of the elbow is moved in a circular path around an axis extending parallel to the surface of a patient's body and also parallel to the surface of an application pad, which allows the pad to impart a percussive and a directional massage stroke when it is applied to the body. The resultant force transmitted to the body has two components: one perpendicular to the body to loosen congestive material, and one force component parallel to the body to mobilize congested material in a selected direction.

7 Claims, 3 Drawing Figures

MASSAGE UNIT

FIELD OF THE INVENTION

This invention relates to medical devices in which medical benefits are achieved through application of vibratory force to the human body. The invention can be used to loosen and to mobilize bronchial secretions in the lungs of humans and in this respect has relationship to devices or techniques which rely upon engagement of the chest or back of an individual to impart a force to the chest cavity to bring about the loosening of bronchial secretions in the lungs. Providing such loosening of bronchial secretions is beneficial to patients suffering from such respiratory ailments as emphysema, asthma, cystic fibrosis, tuberculosis, post operative congestion problems, and other congestive respiratory problems.

The invention is also related to improvements in devices used to apply force to parts of the body, such as the legs, to improve the circulation of blood in the body parts. The invention is further related to devices used to relax the muscles of the body through vibratory action.

In the prior art various methods and devices have been used for these purposes. One method used to loosen bronchial secretions has been by hand massage and percussion. In this technique a nurse or other attendant uses her hands to strike the back or chest of the patient to cause a loosening of the secretions. This can be painful and can even result in broken ribs or severe bruises, especially in infants and in older patients. Sometimes the hand of the nurse or attendant is cupped to strike the back or chest of the patient to provide suction as a result of the cupping so that this suction will have some impact upon loosening the secretions. However such cupping also can result in bruises and broken bones and is considered by many to be ineffectual.

Percussion type vibrators have also been used to loosen bronchial secretions. In their use the vibrator is placed upon the back or the chest of the patient and the vibration unit is operated so that a vibrating member is forced in towards the patient then out away from him repetitiously. This percussion-type movement loosens the bronchial secretions but does not mobilize the secretions to move them out of the congested area.

Another type of vibration unit that is used is the oscillation type, in which the vibrating member rotates about an axis perpendicular to the chest or back of the patient when it is applied. This type of unit provides a massaging circular oscillation force to the body but does not give percussion to loosen the secretions so that they can be mobilized. Also the parallel force is in a circular pattern rather than uni-directional.

Various devices and methods have been used to improve blood circulation, including percussion-type vibrators and oscillation-type vibrators. However these vibratory devices do not help to give a uni-directional impulse to blood flowing in a vessel and the oscillation-types furthermore have their principle vibratory effect near the surface level of the skin and do not have a substantial effect upon venuous flow that is deeper.

Another method used in the prior art to improve blood circulation is for nurses to wrap their hands around a patient's ankle and then move them upward pressing tightly at the same time in order to squeeze blood flow in the direction of the heart. This is a very difficult procedure that is hard work on the part of the nurse. Alternating pressure belts have also been used to improve blood circulation in the leg. This consists of having a series of air bags wrapped around the patient's leg, and then continuously going through the cycle of having pressure increase from the bottom of the leg towards the top so that there is an impulse that has a squeezing effect to force the blood flow up the leg to the heart. This is a complex system that totally encases the leg of the patient and requires difficult synchronization in the application of the pressure to the leg.

In the prior art different techniques are used to relax muscles which become tense and stiff due to a build-up of lactic acid in the muscle and the muscles' inability to rid itself of waste products quickly enough. Prior art vibrators apply percussion or oscillation to the muscle but do not give a continuous directional stroke to the muscle to mobilize the waste products in a direction consistent with the normal direction of blood flow in the muscle.

SUMMARY OF THE INVENTION

The present invention improves over the prior art by providing an applicator pad which when applied to the body imparts a percussive force as well as a directional cross stroke to the body. The invention includes an application unit which comprises a base protion consisting of a stationary part that can be gripped by the hands and an eccentric driving assembly which is mounted upon the stationary part. The stationary part of the base has a handle which is secured to cup-shaped braces and to a bearing support so that a drive cable that is rotatably driven by a motor shaft can be inserted within the handle and coupled to the eccentric drive assembly by a link rod. An elbow shaped connection tube has one end secured to the top of the eccentric drive assembly and extends upwardly and outwardly therefrom with an applicator pad having a foam surface secured to the other end of the elbow. When rotational drive is provided through the cable from the motor the eccentric assembly oscillates about the stationary part of the base and this oscillation moves the pad connected to the elbow in a circular motion relative to the stationary components of the base.

When the surface of the applicator pad is applied to the body, its circular movement imparts a percussive force to the body as well as a directional cross stroke in the direction that the pad moves during the part of its circular cycle in which it is nearest to the body. This stroke through its percussive nature acts to loosen bronchial secretions in the lungs and through its directional stroking action mobilizes the secretions away from a congested area in the direction of the directional cross stroke. Thus the applicator pad, which can have a flat, concave, convex or other shape can be placed against the torso of the body to loosen and to mobilize bronchial secretions in a desired direction.

The pad can also be placed against the body so that the directional stroking action of its circular motion can force blood in a preselected direction through blood vessels so that blood can be given a rapidly-repetitious push in a preselected direction through the vessel. The deep stroking effect provided by the applicator pad creates the directional stroking action not only in blood vessels near the surface of the skin but in deeper vessels as well. Thus blood in the legs can be directionally mobilized towards the heart or towards another selected area.

In the case of use for muscle relaxation, the applicator pad, when applied to the body, imparts a percussive and oscillatory force to the muscle cells to loosen waste material and to force it in the direction of the stroking action. Therefore the waste products can be loosened and forced out of the muscle to provide for muscle relaxation.

DESCRIPTION OF THE PREFERRED EMBODIMENT

Figures 1, 2, 3:
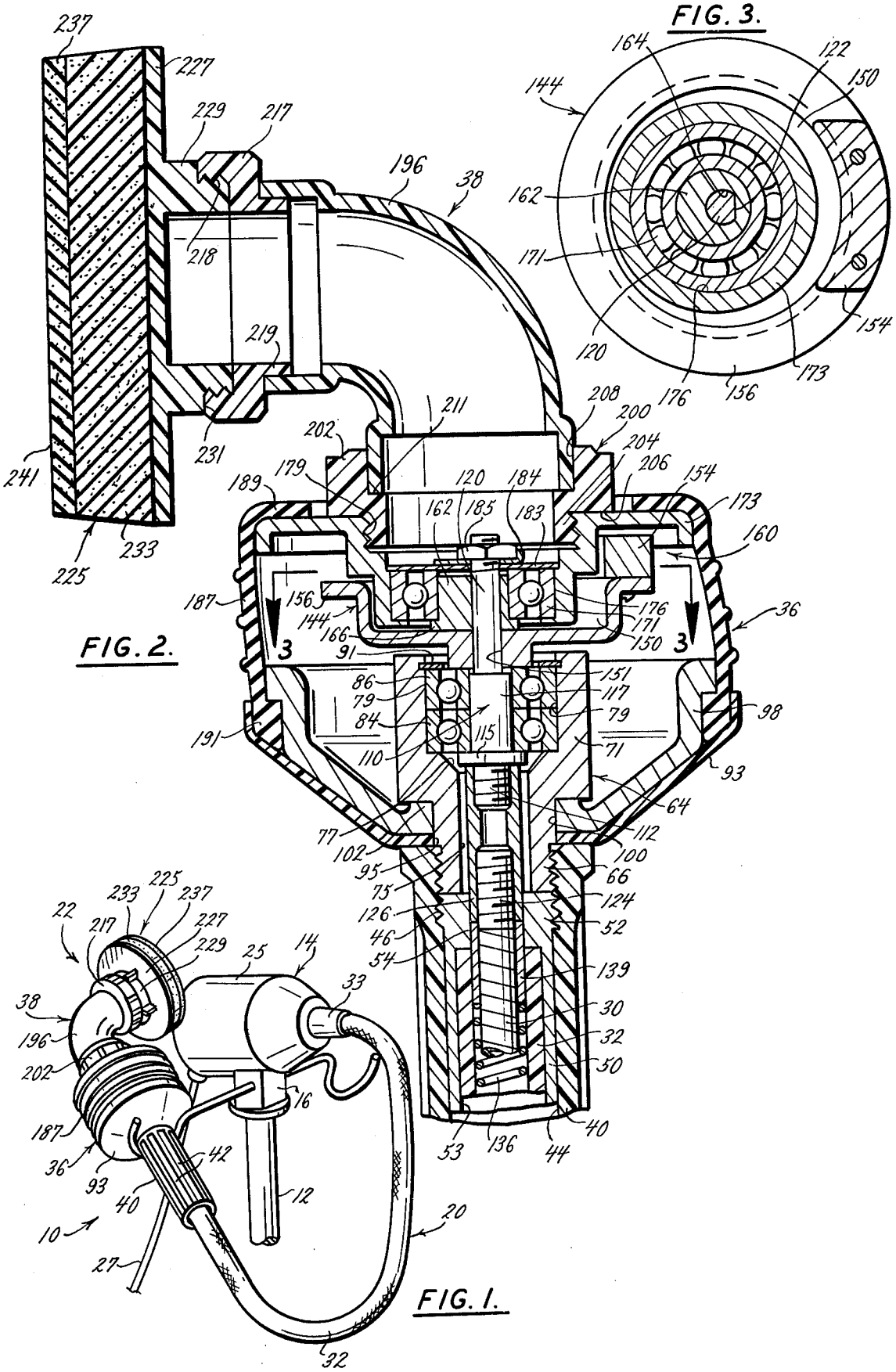
FIG. 1 is a perspective view of the massage applicator unit and its motor unit mounted on a support stand.
FIG. 2 is a side section of the applicator unit.
FIG. 3 is a section of the applicator unit taken on the line 3—3 of FIG. 2.

The massage unit, generally depicted in the drawings as 10, has components which include a tubular stand 12 supported by a base (not shown) upon which is mounted a power unit 14 as by a fitting 16. The power unit 14 transmits rotary power through a transmission line 20 to an applicator unit 22.

The power unit 14 has a motor housing 25 which houses an AC motor (not shown) to which electrical power is supplied through a conductor cable 27. As is well known in the art, a standard rocker switch assembly can be provided for the motor so that the motor can be turned on to drive a motor shaft, and a speed adjustment rocker switch can also be provided for different speeds of rotation of the motor and shaft.

The motor shaft is drivingly engaged to the motor end of a flexible metal cable 30 housed within a flexible sheath 32, which can be of plastic fiber, with the motor end of the sheath 32 securely engaged within a standard coupling sleeve 33 secured to the housing 25 such as by a threaded end which screws into the housing.

Rotational drive of the motor is transmitted through the cable 30 to the applicator unit 22, which comprises a base section 36 upon which is mounted a head section 38 which is caused to oscillate by virtue of its eccentric mounting to the drive linkage within base 36 as will be described.

The base section 36 includes a tubular handle 40 having longitudinal gripping grooves 42 and a cylindrical bore 44 extending the length of the handle with internal threads 46 at the top end of bore 44.

As seen in the bottom portion of FIG. 2, a sleeve 50, which can be of metal, has an externally threaded upper end 52 which screws into the lower part of the handle threads 46, and has a lower cylindrical bore 53 which extends upwardly into a smaller cylindrical counter bore 54 to form an annular shoulder at their junction.

Positioned above the sleeve 50 is a bearing support sleeve 64 which comprises a bottom cylindrical section 66 having an externally threaded lower end which is received by the threads 46 of the handle 40 so that the bottom of section 66 fits flush against the top of lower sleeve 50. The lower section 66 of the support sleeve 64 extends upwardly into a larger cylindrical section 71 forming an annular shoulder which shoulder presses against two cup shaped grip braces to be described. From the bottom of support sleeve 64 a cylindrical bore 75 extends upwardly and tapers at 77 into a larger cylindrical bore 79 with a flat annular thrust shoulder formed between the tapered section 77 and upper bore 79.

Supported within upper bore 79 are a lower bearing 84 which has its outer race supported upon the thrust shoulder 81, and an upper bearing 86 positioned above bearing 84. The bearings 84 and 86 are both telescopically press fitted within bore 79 so that the outer races of bearings 84 and 86 fit flush against the wall of bore 79. A circumferential groove at the upper end of bore 79 receives a lock ring 91 which holds bearings 84 and 86 in position.

Between the upper end of handle 40 and the mid-shoulder of support sleeve 64 is a cup-shaped plastic grip brace 93 with a cylindrical bore 95 that is concentric with handle bore 44. Positioned within the cup 93 is a conforming cup-shaped brace 98, which can be of metal, having a cylindrical bore 100 concentric with handle bore 44 and with an upwardly extending annular flange 102. As seen in FIG. 2 the outer surface of upper cup 98 fits flush against the inner surface of cup 93. The concentric bores of the cups and the handle receive the bottom cylinder of support sleeve 64 so that support sleeve 64 can be screwed into handle 40 to cause the sleeve mid-shoulder to press against flange 102 and thus sandwich the two cups 93 and 98 securely against handle 40.

An annular cavity is formed between the lips of cup 93 and cup 98, and acts to receive and secure the bottom of a rubber jacket yet to be described.

A link rod 110 is provided to transmit rotary motion from the cable 30 to the head 38. Link 110 has a lower externally threaded section 112 which extends upwardly into a larger ring section 115 and thence upwardly through the inner races of bearings 84 and 86 into a smaller cylindrical portion 117, so that an annular shoulder is thus formed between link sections 117 and 115. Link 110 then extends upwardly into a semi-cylindrical key section 120 which has a longitudinally-extending flat 122 that acts as a driving surface as will be described. The upper end of key 120 is externally threaded to engage a lock nut to be described.

As shown at the bottom of FIG. 2, the applicator end of the sheath 32 extends into the lower end of the handle 40 through the bore 53 of the lower sleeve 50, so that the end of the sheath 32 abuts the sleeve shoulder, the sheath being held within bore 53 by an adhesive. The cable 30 has a threaded metal tip 124 soldered to its end and a coupling sleeve 126 has lower internal threads which receive tip 124, as well as upper internal threads which receive the lower threaded end 112 of link 110, so that the cable 30 and link 110 are thereby drivingly engaged. A helical spring 136 extends within the sheath 32 around the cable 30, so that the applicator end of the spring presses against the bottom of a sleeve 139, pressing sleeve 139 upward against the coupling 126 and applying force against link 110 to aid in maintaining it in proper position. The end of the spring 136 located at the motor end of the sheath 32 is held in position so as to maintain the spring 136 in compression.

Mounted above the bearing 86 is a counterbalance dish 144 having a lower cylindrical projection which rests on the top of the inner race of bearing 86. Dish 144 has a cylindrical recession 150 that extends downwardly into a center bore 151 of semi-cylindrical shape which conforms to the shape of link key 120 so that the key 120 drivingly engages dish 144. An arcuate shaped counterweight 154 is firmly secured to the outer rim 156 of the dish 144 such as by screws or the like to off-set the weight of eccentrically mounted members to be described.

An eccentric drive assembly 160 is positioned above the dish 144 and includes a hub 162 which has an off-centered semi-cylindrical bore 164 which conforms in shape to the link key 120 which extends therethrough for driving engagement. Hub 162 has a lower cylindrical bottom section 166 which rests flush against the top of the dish recession 150 forming an annular shoulder to support the inner race of a bearing 171 which is press-fit around the hub.

The eccentric assembly 160 further includes a symmetrical oscillation plate 173, that has a cylindrical bore 176 which receives the outer race of bearing 171 as by a press-fit so that the lower portion of the outer race is supported upon a flat annular shoulder of an inwardly extending projection at the bottom of plate 173. Oscillation plate 173 has an upper internally threaded bore 179 which terminates at its lower end in an inwardly extending shoulder. A sealing washer 183 rests above the bearing 171 above bore 176 and a smaller washer 184 is mounted above washer 183. A nut 185 is screwed on the upper threaded end of link key 120 to hold the drive assembly 160 securely against the dish 144, and further to press the bottom of the dish 144 against the bearing 86.

The oscillation plate 173, being mounted about the bearing 171 and the concentrically mounted hub 162, is therefore also eccentrically mounted so that rotation of the link 110 causes the plate 173 to oscillate.

A cover jacket 187, made of a flexible material such as rubber, has its upper end 189 secured around the top of oscillation plate 173 such as by an adhesive. Jacket 187 extends downwardly to surround the drive assembly 160 and dish 144 and has a thicker lower end 191 secured within the cavity between the cap lips. The jacket 187 holds the plate 173 against rotation but allows it to oscillate in a generally circular manner upon rotation of the link 110.

The applicator head 38, located above the applicator base 36, comprises a tubular elbow with a ring shaped fitting 200 at its lower end. The fitting has an enlarged upper section 202 and an externally threaded lower section 204. The section 204 is screwed into the threaded bore 179 of oscillation plate 173 so than an annular shoulder 206 formed between fitting sections 202 and 204 fits flush against the top surface of plate 173. The fitting 200 has an upper annular recess which receives the lower end of the elbow. At the other end of the elbow is a fitting 217 having an internally threaded bore 218, and a cylindrical projection 219 which is telescopically received within the other end of the elbow.

A pad unit 225 is secured to fitting 217 and includes a circular disc 227 which is integral with a hub 229 having external threads which screw into threads 218. The disc 227 and its extension 229, as well as elbow 196 and fittings 200 and 217 can be made of a light material such as plastic. The disc 227 is covered by a first layer 233 of a soft material such as foam rubber secured to the disc 227 as by an adhesive. A second layer 237 of like material is secured to the first. The exterior surface 241 of the foam layer 237 is shown to be generally flat but can be of other desired shapes such as for example, concave and convex.

Operation

In operation, the applicator unit 22 can be gripped about the handle 40 with the hand braced against grip cup 93 to firmly hold the unit. Preferably, two hands are used by the operator and, if desired, part of the hands can be placed about the rubber jacket 187. The unit 22 can thus be held by the hands of an attendant or by the hands of an individual patient so that the surface 241 of pad unit 225 is flat against a part of the body, such as the chest, in the position desired. With the motor "on", the rotation of the motor shaft is transmitted through cable 30 to rotate it within sheath 32. The driving rotation of cable 30 is transmitted through coupling 126 to link 110 and through the link key 120 to rotate hub 162. Axial guidance of the rotation of link 110 is provided by bearings 84 and 86 which are held in position by lock ring 91 so that wobbling of the link is avoided.

The rotation of hub 162 acts through bearing 171 to oscillate the plate 173 and thereby oscillates the head section 38 mounted upon the plate 173 so that the elbow moves pad 225 and surface 241 in a circular path relative to the handle 40, cups 93 and 98, and support sleeve 64. Thus the movement of the pad 225 and surface 241 during a stroke is circular relative to an axis which extends through the center of the handle, cups and support sleeve, which axis is generally parallel to the surface 241. The pad 225 and surface 241 is thus moved inward toward the body surface and across the body surface thereby imparting to the patient an angular force produced by both perpendicular and parallel components with respect to the body surface to which the surface 241 is applied. This movement imparts a percussive force against the patient's body as well as a directional stroking force across the surface of the patient's body. The directional stroke depends upon the direction of the circular movement of pad 225 and is in the direction that the pad 225 moves across the body when the pad 225 is closest to the body. For example, if the surface 241 of pad 225 is placed flat against the chest of the body at shoulder level, with the elbow and handle 40 extending longitudinally toward the feet relative to the torso, the stroke will have a direction from the left shoulder to the right shoulder when the link 110 is rotated counterclockwise (from the downward looking perspective of FIG. 3). Conversely, when the link 110 rotation is reversed, the direction of the stroke is from the right to the left shoulder.

The percussive force of the pad 225 acts to loosen bronchial secretions while the directional force has the effect of mobilizing the secretions in the direction of the directional stroke. The pad 225 can thus be placed against the torso in selected positions to mobilize bronchial secretions away from an area in a chosen direction.

The applicator pad 225 can also be used to improve blood circulation in body parts such as the legs. In this case, the surface 241 of the pad 225 is placed along the leg at a location where improved circulation is desired so that the pad will have a directional stroke in the direction in which increased blood flow is desired. When the eccentric assembly 160 oscillates the head 38, the pad 225 imparts a force to the blood vessels so that the blood is forced in the preselected direction through the blood vessels. Thus the pad 225 can be so placed to propel blood from the leg toward the heart, or toward another body area. In use with the leg, the applicator pad having a concave application surface can be used so that the applicator surface can better conform to the shape of the body surface.

In use to relax muscles, the pad 225 can be placed against a body part so that the percussive directional stroking effect of the pad can reach a selected muscle such as the muscles in the thigh of the leg. The circular movement of the pad 225 imparts a percussive and a directional force to the muscles. The percussive force helps to loosen waste products from the muscle and the directional stroking mobilizes these waste products out of the body of the muscle so that they can be discarded by the body.

During the operation of the applicator unit 22, the cover jacket 187 acts to prevent the hands or other body parts from being harmed by any of the moving parts of the applicator unit 22. The counterweight 154 secured to the dish 144 acts to offset the weight of the eccentrically mounted drive assembly 160 so that an unbalanced force does not deform the link 110 or cause excessive wobbling of the handle 40.

Pad units having convex, concave, or other shaped application surfaces can be interchanged with the pad unit 225 by simply unscrewing the pad unit 225 from fitting 217 and screwing in another pad unit having the surface shaped desired.

Various changes and modifications may be made in this invention, as will be readily apparent to those skilled in the art. Such changes and modifications are within the scope and teaching of this invention as defined by the claims appended hereto.

What is claimed is:

1. A massage apparatus operable by a human for therapeutic application to a patient comprising:

(a) a base section having a portion to be gripped by the human;

(b) a member mounted eccentrically on the base for eccentric rotation while the grippable base section portion is stationary;

(c) drive linkage extending through the grippable portion and engaged with the eccentric member to rotate the eccentric member while the base is stationary;

(d) an application surface to be applied to the body of the patient;

(e) an elbow member having a first end connected to the eccentric member for orbital movement of said first end, and a second offset end connected to the application surface to revolve the application surface by orbital movement of said first end while the grippable portion is stationary.

2. The structure of claim 1 wherein the application surface is substantially flat.

3. The structure of claim 1 wherein the application surface is resilient.

4. The structure of claim 1 further comprising a cable drivingly connected to the linkage, and a motor connected to the cable to rotate the cable and drive the linkage.

5. A massage apparatus operated by a human for therapeutic use comprising:

(a) a base section having a portion to be gripped by the human;

(b) drive linkage extending through the grippable portion;

(c) a dish member mounted on the base and drivingly engaged with the drive linkage for orbital movement by the drive linkage;

(d) a hub mounted eccentrically relative to the linkage above a portion of the dish, and means to counterbalance the rotation of the hub;

(e) an oscillation plate mounted about the hub for orbital movement;

(f) an applicator surface to be applied to the body of the patient;

(g) an elbow member having a first end connected to the oscillation plate for orbital movement of said first end, and a second offset end connected to the applicator surface to revolve the applicator surface by orbital movement of said first end while the grippable portion is stationary.

6. The structure of claim 5 wherein the application surface is resilient and substantially flat.

7. The structure of claim 5 further comprising a cable drivingly connected to the linkage, and a motor drivingly connected to the cable to rotate the cable and drive the linkage.

* * * * *